US009743700B2

(12) United States Patent
Arai

(10) Patent No.: US 9,743,700 B2
(45) Date of Patent: Aug. 29, 2017

(54) HELMET

(71) Applicant: Michio Arai, Saitama (JP)

(72) Inventor: Michio Arai, Saitama (JP)

( * ) Notice: Subject to any disclaimer, the term of this patent is extended or adjusted under 35 U.S.C. 154(b) by 728 days.

(21) Appl. No.: 13/926,483

(22) Filed: Jun. 25, 2013

(65) Prior Publication Data

US 2013/0340148 A1 Dec. 26, 2013

(30) Foreign Application Priority Data

Jun. 26, 2012 (JP) ..... 2012-143539

(51) Int. Cl.
*A42B 3/08* (2006.01)
*A42B 3/32* (2006.01)

(52) U.S. Cl.
CPC ..... *A42B 3/08* (2013.01); *A42B 3/326* (2013.01)

(58) Field of Classification Search
CPC ..... A42B 3/08; A42B 3/326; A42B 3/085; A42B 3/32; A42B 3/18; A42B 3/20; A42B 3/205
USPC ..... 2/421, 424, 9
See application file for complete search history.

(56) References Cited

U.S. PATENT DOCUMENTS 1,060,220 A * 4/1913 White ..... A42B 3/20 2/9
2,790,175 A * 4/1957 Sowle ..... A42B 3/08 2/9
3,216,023 A * 11/1965 Morgan ..... A42B 3/08 128/857
4,538,303 A * 9/1985 Schnitzler ..... A42B 3/24 2/424
4,766,615 A * 8/1988 Morin ..... A42B 3/326 2/410
4,769,857 A * 9/1988 Cianfanelli ..... A42B 3/326 2/421
5,088,131 A * 2/1992 Kamata ..... A42B 3/222 2/424
5,093,936 A * 3/1992 Copeland ..... A42B 3/14 2/410
5,136,657 A * 8/1992 Hattori ..... A42B 3/127 2/421

(Continued)

FOREIGN PATENT DOCUMENTS

| | | |
|---|---|---|
| DE | 3143796 | 5/1983 |
| JP | 734312 | 2/1995 |
| WO | 2009133437 | 11/2009 |

OTHER PUBLICATIONS

English Abstract of JP 734312.
English Abstract of DE 3143796.

*Primary Examiner* — Alissa L Hoey
(74) *Attorney, Agent, or Firm* — Dykema Gossett PLLC

(57) ABSTRACT

A helmet for use by a driver of a vehicle or vessel includes a chin guard extending from side to side over the front open part of a helmet shell molded to an open-face shape, and supported about an axis passing through the right to left side of the helmet shell so as to swivel up and down, the chin guard including a surface layer member formed from a flexible material so as to be deformable by deflection into a shape conforming to different widths of different helmet shells, and a core member formed from a rigid material and mounted inside of the surface layer member to inhibit the surface layer member from deflection.

3 Claims, 6 Drawing Sheets

(56) References Cited

U.S. PATENT DOCUMENTS 5,384,914 A * 1/1995 Caveness ..... A42B 3/20 2/424
5,388,277 A * 2/1995 Taniuchi ..... A42B 3/283 2/171.3
5,619,755 A * 4/1997 Casartelli ..... A42B 3/326 2/422
5,621,923 A * 4/1997 Tapocik ..... A42B 3/227 2/12
6,212,689 B1 * 4/2001 Lee ..... A42B 3/222 2/424
6,226,803 B1 * 5/2001 Tanaka ..... A42B 3/326 2/424
6,249,918 B1 * 6/2001 Lacroix ..... A42B 3/222 2/424
6,289,521 B1 * 9/2001 Ikeda ..... A42B 3/105 2/421
6,934,971 B2 * 8/2005 Ide ..... A42B 3/08 2/424
7,376,981 B2 * 5/2008 Shida ..... A42B 3/326 2/424
7,841,026 B2 * 11/2010 Makris ..... A42B 3/0433 2/410
8,959,668 B1 * 2/2015 Ganes ..... A42B 3/205 2/410
2003/0070200 A1 * 4/2003 Crye ..... A42B 3/08 2/6.6
2003/0182716 A1 * 10/2003 Wu ..... A42B 3/326 2/424
2004/0250337 A1 * 12/2004 Pietrzykowski ..... A42B 1/004 2/195.3
2005/0015861 A1 * 1/2005 Gafforio ..... A42B 3/326 2/424
2005/0120467 A1 * 6/2005 Desarmaux ..... A42B 3/16 2/422
2006/0000011 A1 * 1/2006 Reichow ..... A42B 3/225 2/424
2007/0083967 A1 * 4/2007 Crossman ..... A42B 3/044 2/15
2007/0163158 A1 * 7/2007 Bentz ..... A42B 3/0406 40/329
2007/0250993 A1 * 11/2007 Schimpf ..... A42B 3/326 2/424
2008/0196148 A1 * 8/2008 Morin ..... A42B 3/326 2/421
2008/0216215 A1 * 9/2008 Lee ..... A42B 3/326 2/424
2009/0031480 A1 * 2/2009 Torres ..... A42B 3/063 2/413
2009/0031483 A1 * 2/2009 Wallerberger ..... A42B 3/328 2/421
2010/0132095 A1 * 6/2010 Gafforio ..... A42B 3/326 2/421
2011/0302701 A1 * 12/2011 Kuo ..... A42B 3/326 2/421
2012/0284906 A1 * 11/2012 Kuo ..... A42B 3/223 2/424
2013/0081199 A1 * 4/2013 Nimura ..... A42B 3/326 2/421
2015/0026858 A1 * 1/2015 Ross ..... A42B 3/18 2/2.5

* cited by examiner

HELMET

FIELD OF THE INVENTION

The present invention relates to a helmet worn by drivers of various types of vehicles such as automobiles and motorcycles, vessels such as motor boats, as well as other transportation means such as bicycles.

BACKGROUND OF THE INVENTION

There is known a helmet, other than a full-face helmet and an open-face helmet when driving vehicles such as automobiles and motorcycles, rotatably equipped with a chin guard crossing over the front open part from the right to left side of the open-face helmet to cover the chin part of a wearer as described in Patent literature 1.

DESCRIPTION OF THE RELATED ART

As related art literature information relevant to the present invention, we note Japanese laid-open Patent Publication No. 7-34312 [Patent literature 1].

SUMMARY

According to the prior art in Patent literature 1, there is provided a helmet having both the functions of a full-face helmet covering most of the face including the chin part of a wearer and of an open-face helmet offering such as favorable open feeling by exposing a wearer's face.

However, in the related art shown in the patent literature 1, because the chin guard is configured with a surface layer member molded from a synthetic resin material and a liner molded from a material such as an urethane foam lined with the surface layer member, its strength is less than that of the chin guard part of a helmet shell casted in a full-face shape from a material such as a reinforced fiber material, thus the chin guard may not fulfill a fundamental function.

The objects of the prevent invention are to make it possible to improve the effectiveness in strength of the chin guard in state of a full-face helmet and to form the chin guard in a shape conforming to the size of a helmet shell while having both the functions of a full-face helmet covering most of the face including the chin part of a wearer and of an open-face helmet offering such as preferable open feeling by exposing a wearer's face, and so forth.

In order to achieve such objects, a helmet according to the present invention is provided with at least the following configuration.

There is provided a helmet comprising a chin guard crossing over the front open part of a helmet shell from side to side, the helmet shell configuring the outmost layer of the helmet and molded to an open-face shape, the chin guard supported about an axis passing through the right to left side of the helmet shell so as to swivel up and down, wherein the chin guard includes a surface layer member made of a flexible material to be deformable by deflection in a shape conforming to a different size of the helmet shell and a core member made of a rigid material and mounted at a position inside of the surface layer member and facing at least the front open part, the core member serving to inhibit the surface layer member from deflection and to adjust the surface layer member in a shape conforming to the size of the helmet shell.

There is provided a plurality of types of the core member to form a shape conforming to each different size of the helmet shell.

The core member is made of the same material as the helmet shell.

ADVANTAGES OF THE INVENTION

With such the aspects, the present invention offers the following advantages. By providing a rigid core member inside of a flexible surface layer member to inhibit the surface layer member from deflection and to form a shape conforming to the size of a helmet shell, it makes possible to improve the effectiveness in strength of a chin guard and to form the chin guard in a shape conforming to the size of the helmet shell in state of a full-face helmet while having both the functions of a full-face helmet covering most of the face including the chin part of a wearer and an open-face helmet offering such as favorable open feeling by exposing the wearer's face.

DESCRIPTION OF THE PREFERRED EMBODIMENTS

A helmet shell described below configures the outmost layer of a helmet and, for example, is molded to an open-face shape from a reinforced fiber resin material (GFRP, CFRP, and so forth) which is made by impregnating a reinforced fiber material (glass fiber, carbon fiber, and so forth) with a thermoset resin material (an epoxy resin material, a phenol resin material, and so forth), or a thermoplastic resin material (polycarbonate, and so forth).

The right and left described below means horizontal direction along the cheek part of a wearer of the helmet. The front described below means a side of the wearer's face of the helmet. The top described below means a side of a top of the head of the helmet, and the bottom means a side of the chin part of the helmet.

A flexible material described below is, for example, an ABS resin material (acrylonitrile, butadiene, a styrene copolymer synthetic resin material), an acrylic resin material, an epoxy resin material, or so forth.

A rigid material described below is, for example, a reinforced fiber resin material (GFRP, CFRP, and so forth) which is made by impregnating a reinforced fiber material (glass fiber, carbon fiber, and so forth) with a thermoset resin material (an epoxy resin material, a phenol resin material, and so forth), or a thermoplastic resin material (polycarbonate, and so forth), which is rigid as well as lightweight. In addition, metal (iron and alloy consisting primarily of iron)

or non-ferrous metal (aluminum, magnesium, titanium, copper and so forth, and alloy consisting primarily of these) may be used.

The inside described below means a side of the wearer of the helmet.

Figure 1:
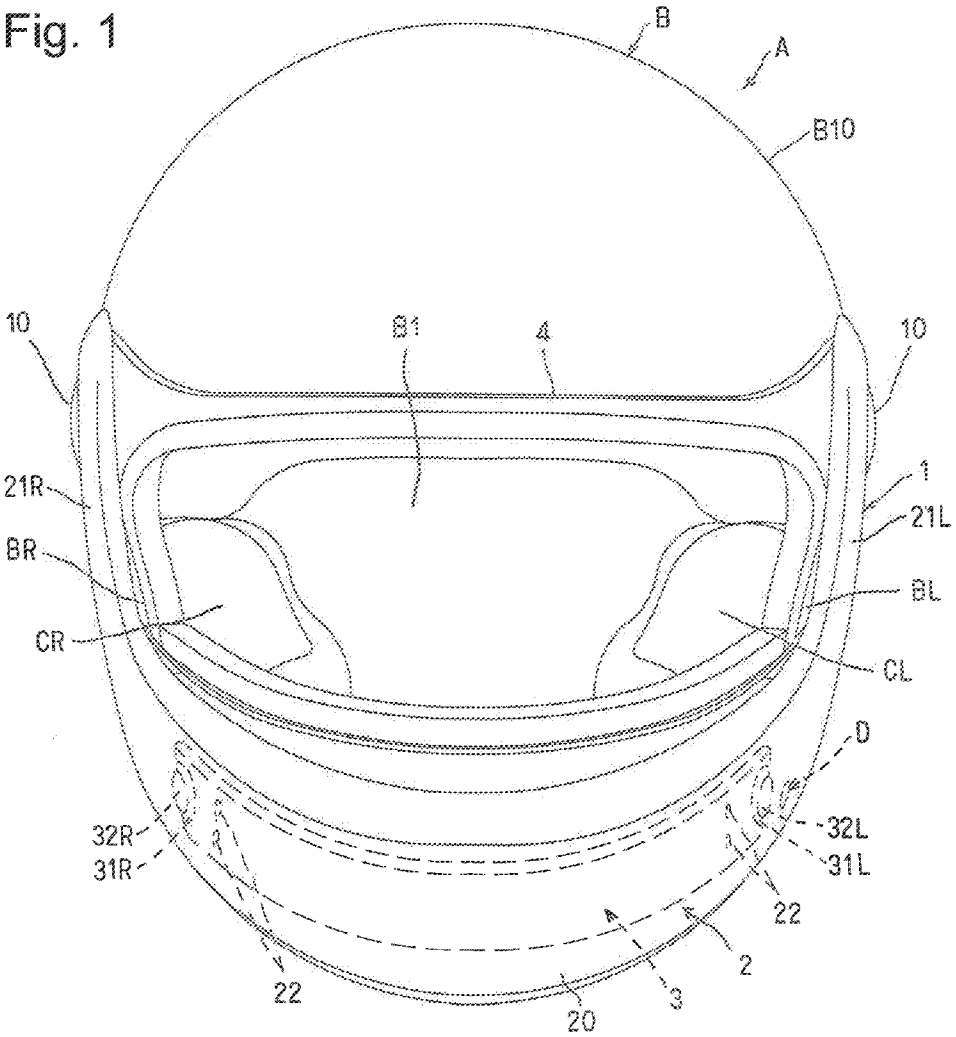
FIG. 1 is a front view of a helmet according to an embodiment of the present invention.
Figure 2:
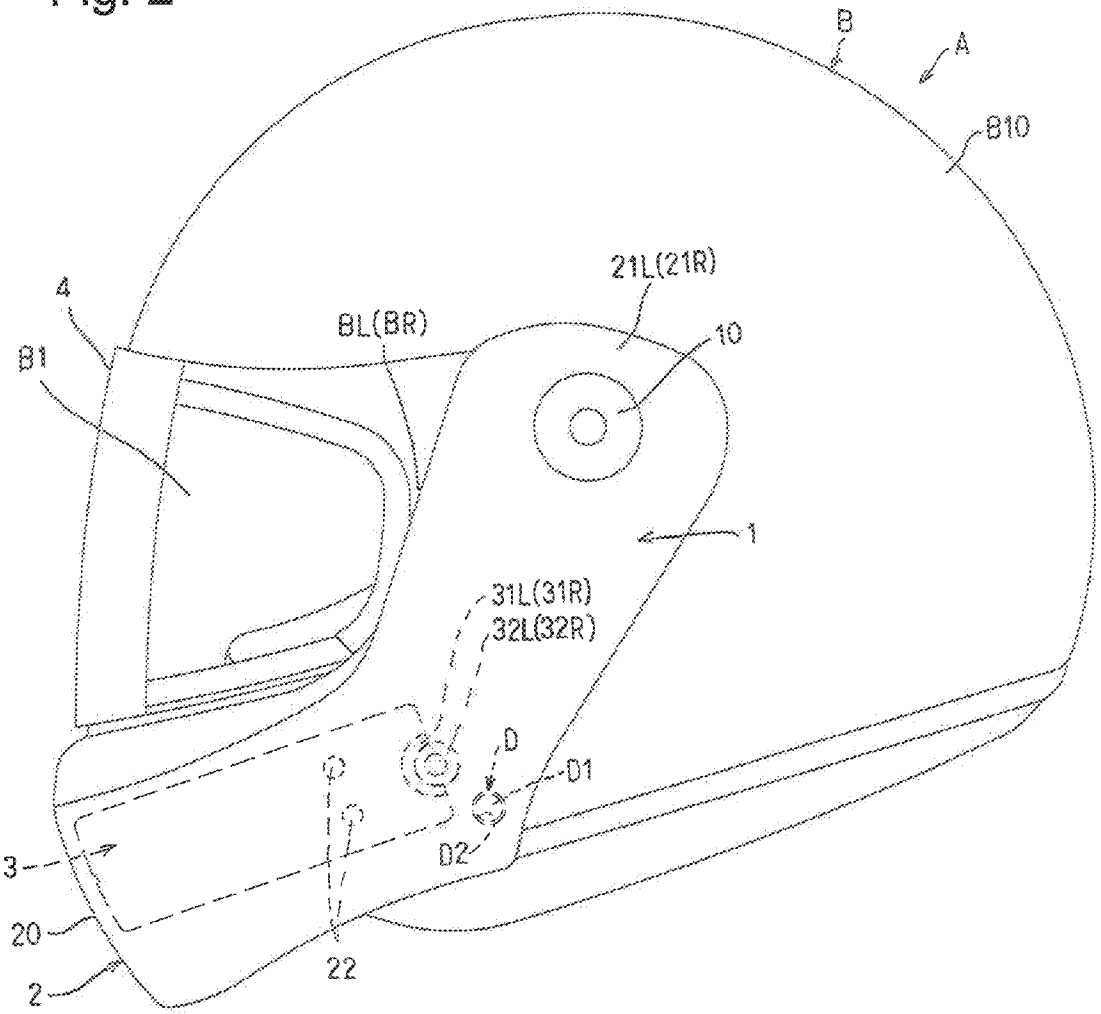
FIG. 2 is a left side view of FIG. 1, the chin guard being in a downmost position.
Figure 3:
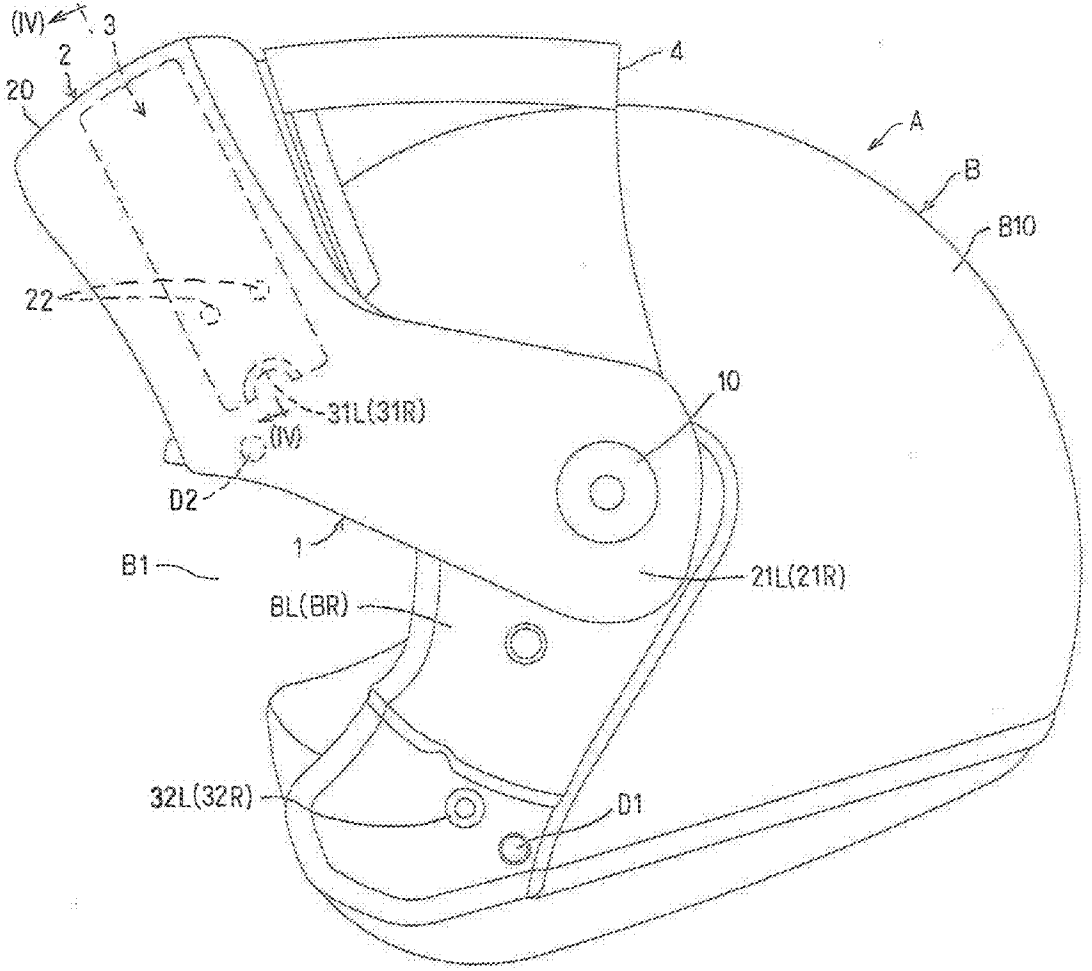
FIG. 3 is a left side view illustrating the chin guard in an upward position.
Figure 4:
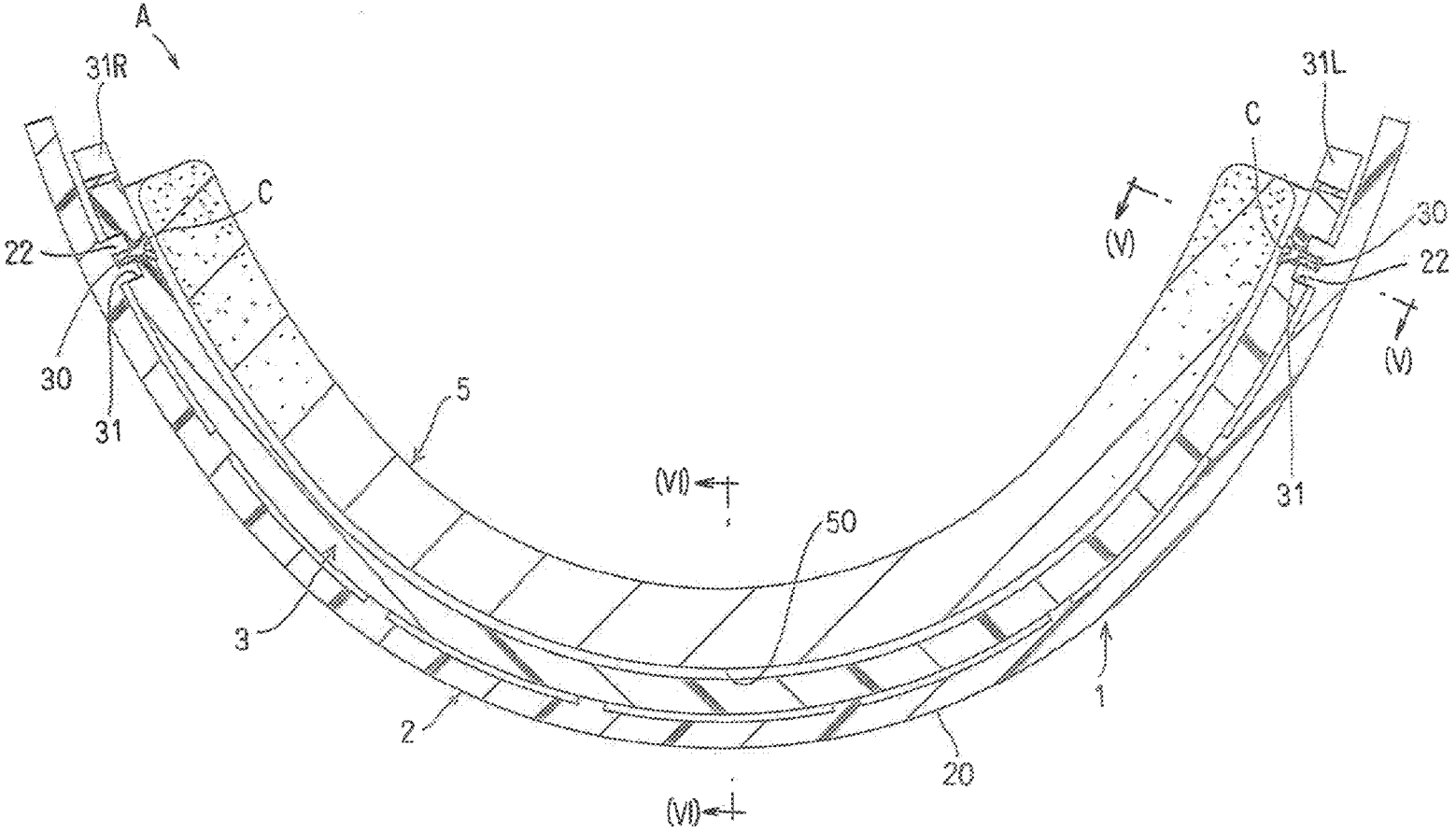
FIG. 4 is a cross-sectional view taken along line (IV)-(IV) of FIG. 3.
Figure 5:
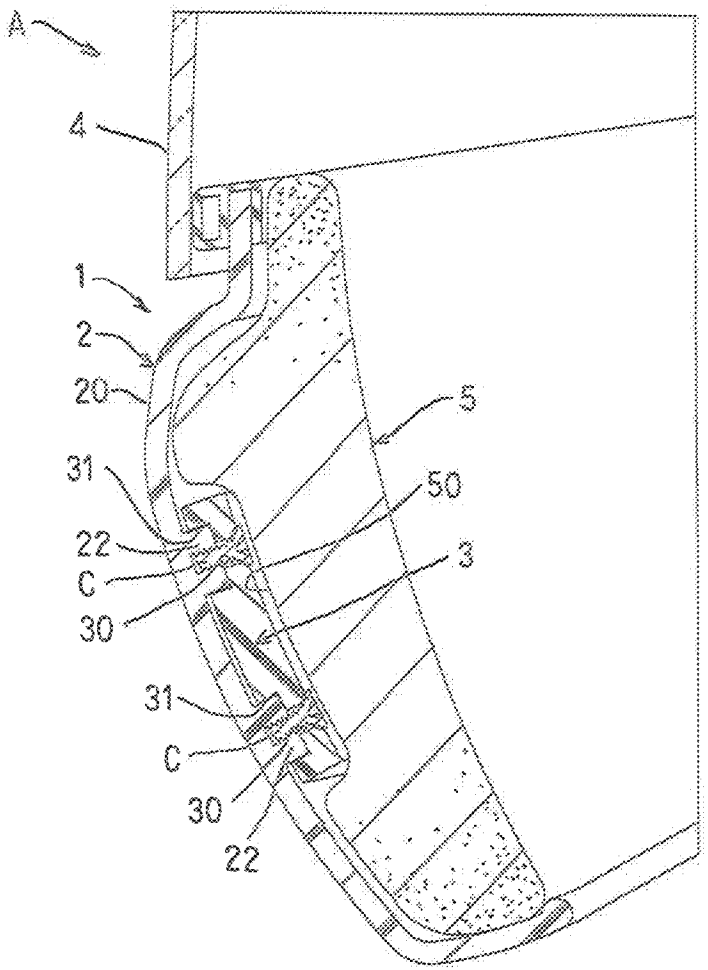
FIG. 5 is a cross-sectional view taken along line (V)-(V) of FIG. 4.
Figure 6:
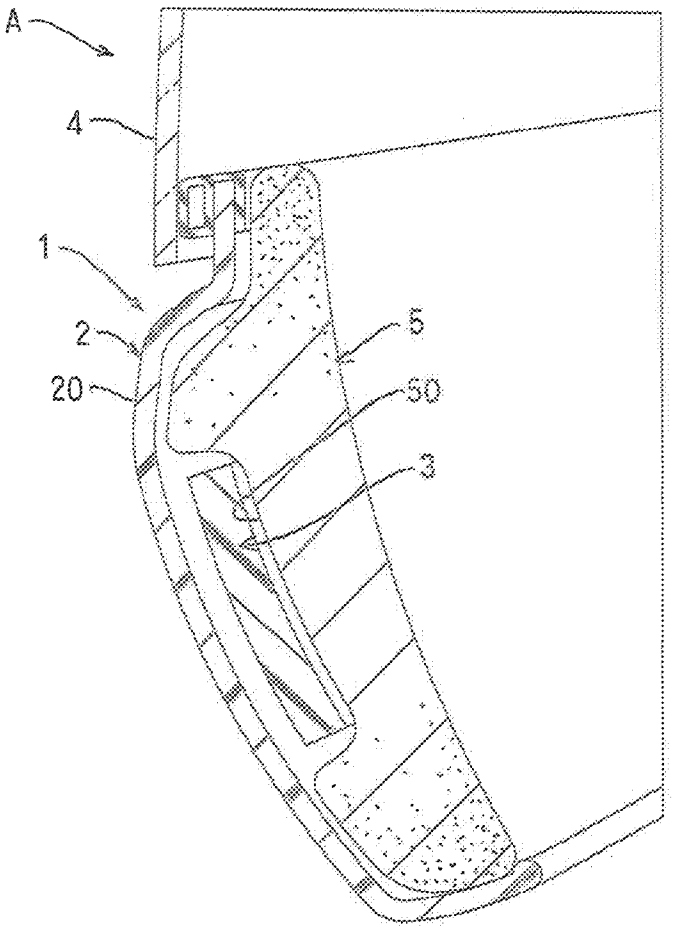
FIG. 6 is a cross-sectional view taken along line (VI)-(VI) of FIG. 4.

Hereinafter, a helmet A according to an embodiment of the present invention (hereinafter, "helmet") is described on the basis of FIGS. 1 to 4. The present invention is not limited to the embodiments which are described below.

A helmet A comprises:

- an impact absorbing liner (not shown) molded from an expanded polystyrene material or a comparable material in shock-absorbing performance to the expanded polystyrene material, inside of a head part B10 of a helmet shell B molded to an open-face shape from a reinforced fiber resin material;
- a head part pad (not shown) made of such as an urethane material and disposed inside of the impact absorbing liner;
- cheek pads CL, CR held detachably on the inner surface of both the right and left sides BL, BR respect to the cheek part of the helmet shell B;
- a chin guard 1 crossing over the front open part B1 of the helmet shell B from the right side BR to the left side BL and supported about a supporting axis part 10 being an axis passing through the right to left side of the helmet shell so as to swivel up and down; and
- a locking device D locking the chin guard 1 to the helmet shell B at the lower limit swiveling position (where the helmet A is in state of a full-face helmet).

The chin guard 1 includes a surface layer member configuring an outer surface layer of the chin guard 1, a core member 3 disposed inside of the surface layer member 2, a chin part cover member 5 disposed inside of the core member 3 and made of the same material as the aforementioned impact absorbing liner and a shield 4 disposed above of the surface layer member 2, wherein the front open part B1 is closed or open by swiveling about a supporting axis part 10.

The surface layer member 2 is molded to a shape covering the chin part of the wearer from a flexible synthetic resin material to cross over the helmet shell B from the right side BR to the left side BL, and is formed by deflection in a shape conforming to the size of a helmet shell B of which a plurality of sizes are prepared.

The surface layer member 2 includes a chin guard body part 20 disposed in front of the front open part B1 so as to face the front open part B1 and axis supporting plate parts 21L, 21R connected to the right and left of the chin guard body part 20 and having a supporting axis part 10, wherein the axis supporting plate parts 21L, 21R are supported about the left side BL and the right side BR of the helmet shell B respectively.

Around the right and left edges of the inner surface of the chin guard body part 20, while screws C are screwed in to mount the core member 3 inside of the chin guard body part 20, a tubular body 22 vertically stands so as to fit in the core member 3.

By the core member 3 molded to a shape following the inside shape of the chin guard body part 20 from a reinforced fiber resin material which is the same as a material of the helmet shell B, or a material of comparable rigidity to the reinforced fiber resin material and mounted on the chin guard body part 20, it makes possible to improve the rigidity of the surface layer member 2 to reinforce the surface layer member 2, as well as to adjust the core member 3 in a shape conforming to the size of the helmet shell B of the surface layer member 2 to inhibit the surface layer member 2 from deflection for its rigidity.

There is provided a plurality of types of the core member 3 to form a shape conforming to each different size of the helmet shell B, and therefore it makes possible to adjust the surface layer member 2 into a shape conforming to the size of the helmet shell B, mainly in the horizontal direction (in the width direction) to mount the core member 3 adapting the size of the helmet shell B on the chin guard body part 20.

The core member 3 has a screw through-hole 30 where the screw C passes through, and the core member 3 is mounted on the chin guard body part 20 by the screw C passing through the screw through-hole 30 and screwed into the tubular body (projection) 22.

Also, the core member 3 includes a fitting concave portion 31 fitting in the tubular body 22, the fitting concave portion 31 formed so as to have the same axis as the screw through-hole 30 and the radius fitted in the tubular body 22 compatibly, and therefore it makes possible to set the core member 3 at the predetermined position with respect to the chin guard body part 20 to fit the fitting concave portion 31 in the tubular body 22.

Similarly, the core member 3 may be mounted on the chin guard body part 20 by adhesives, engaging means disposed to the chin guard body part 20 and the core member 3 (e.g. engaging a concave portion to a convex portion), combination of both the adhesives and the engaging means or so forth.

Contact plates 31L, 31R made of hard materials such as a metal material are mounted at the right and left ends of the core member 3, wherein the contact plates 31L, 31R contacting with the stopper member 32L, 32R disposed at the respective left and right sides BL, BR inhibits the chin guard 1 from swiveling down below the lower limited swiveling position (downmost position).

The stopper members 32L, 32R are disposed at a position to contact with the respective contact plates 31L, 31R when the chin guard 1 reaches the lower limit swiveling position.

Also, the end surfaces of the core member 3 may directly contact with the stopper member 32L, 32R to skip the contact plates 31L, 31R.

Also, the core member 3 may be formed in a shape to wholly or partially extend to axis supporting plate parts 21L, 21R to wholly or partially reinforce the surface layer member 2.

The shield 4 is formed in the predetermined shape from a polycarbonate material with a color which is transparent or to have enough visibility, and supported about the supporting axis part 10 so as to swivel. Such the shield 4 may swivel dependently or independently of the surface layer member 2, and the front open part B1 may be partially open by the shield 4 swiveling up and down with respect to the surface layer member 2 when helmet A is in a state of a full-face helmet.

The chin part cover member 5 is molded to a shape conforming to the size of the helmet shell B and following the inside shape of the chin guard body part 20. A groove part 50 is horizontally provided through the chin part cover member 5 to engage the core member 3 mounted inside of the chin guard body part 20.

The locking device D includes a protrusion D1 provided at the outer surface side of the left side part BL and a concave part D2 provided inside of the axis supporting plate part 21L, wherein the chin guard 1 may be locked with respect to the helmet shell B by the protrusion D1 engaging the concave part D2 at the lower limit swiveling position of the chin guard 1 to keep the helmet A in state of a full-face helmet.

Furthermore, releasing the engagement between the protrusion D1 and the concave part D2 unlocks the chin guard 1 respect to the helmet shell B, and thereby the chin guard 1 may swivel up to have the helmet A in state of an open-face helmet.

The locking device D may be provided at the axis supporting plate part 21R or at both the axis supporting plate parts 21L, 21R. The locking device D is not limited to the exemplified configurations.

The helmet A of the above configuration makes possible to improve the effectiveness in strength of the chin guard 1 in state of a full-face helmet while having both the functions of a full-face helmet covering most of the face including the chin part of a wearer and of an open-face helmet offering such as favorable open feeling by exposing the wearer's face.

Moreover, the aforementioned shape and flexibility of the core member 3 allows the chin guard 1 formed in a shape conforming to the size of the helmet shell B and kept in the shape as well.

Moreover, there is provided a plurality of types of the core member 3 formed in a shape conforming to each different size of the helmet shell B, and thereby the surface layer member 2 may be accurately and readily adjusted in a shape conforming to the different size of the helmet shell B.

Moreover, the core member 3 is molded from a material same as the helmet shell B, and thereby both lightweight and desired strength may be obtained. Therefore, curbing increase in weight of the chin guard 1 curbs increase in weight of the helmet A, and thereby a wearer may be comfortable to wear the helmet A.

Moreover, the locking device D may keep the helmet A in state of a full-face helmet, and the face of a wearer is reliably shielded to prevent the chin guard from flapping open unnecessarily in such as the wind during driving.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

REFERENCE NUMERALS

A: helmet
B: helmet shell
B1: front open part
1: chin guard
2: surface layer member
3: core member

What is claimed is:

1. A helmet for a driver of a vehicle or vessel, said helmet comprising:

a shell which provides a left side, a right side and an open front, a chin guard which extends across the open front of the shell and is mounted by aligned supporting parts at the respective left and right sides of said shell so as to be swivelable up and down relative to the open front, said chin guard including a deformable surface layer member which extends across the open front of the shell, and a rigid core member which is located adjacent an inside surface of the surface layer member and extends across the open front of the shell to provide additional stiffness to the surface layer member, said rigid core member including opposite left and right ends and respective screw holes which extend therethrough adjacent the left and right ends, said deformable surface layer member including projections extending from the inside surface of the surface layer member which are aligned with the screw holes, and respective screws which extend through said screw holes and into said projections for attaching the rigid core member to the deformable surface layer member, and a transparent face shield positioned above the surface layer member and swivelable up and down to cover or uncover the open front of said shell.

2. The helmet according to claim 1, wherein said shell and said core member consist of an identical material.

3. A helmet for a driver of a vehicle or vessel, said helmet comprising:

a shell which provides a left side, a right side and an open front, said left and right sides including respective stopper members extending outwardly therefrom, a chin guard which extends across the open front of the shell and is mounted by aligned supporting parts at the respective left and right sides of said shell so as to be swivelable up and down relative to the open front, said chin guard further including a deformable surface layer member which extends across the open front of the shell, and a rigid core member which is attached to an inside surface of the surface layer member and extends across the open front of the shell to provide additional stiffness to the surface layer member, said rigid core member including opposite left and right ends, each of the left and right ends including an external contact plate attached thereto and configured to abut one of said stopper members when the chin guard is swiveled to a downmost position, and a transparent face shield positioned above the surface layer member and swivelable up and down to cover or uncover the open front of said shell.

* * * * *